United States Patent [19]

Garron et al.

[11] 4,159,688

[45] Jul. 3, 1979

[54] METHOD OF FORMING A BUTTONHOLE PATTERN

[75] Inventors: Stephen A. Garron, Elizabeth; Charles R. Odermann, Montville, both of N.J.

[73] Assignee: The Singer Company, New York, N.Y.

[21] Appl. No.: 928,939

[22] Filed: Jul. 28, 1978

[51] Int. Cl.[2] ..... D05B 3/06

[52] U.S. Cl. ..... 112/264.1; 112/158 B

[58] Field of Search ..... 112/264, 158 B, 65, 112/437; 24/202

[56] References Cited

U.S. PATENT DOCUMENTS

| | | | |
|---|---|---|---|
| 1,033,721 | 7/1912 | Miller | 112/158 B |
| 1,483,184 | 2/1924 | McCann | 112/264 X |
| 2,977,913 | 4/1961 | Schenkengel | 112/264 |
| 3,570,433 | 3/1971 | Weisz | 112/264 |
| 4,009,673 | 3/1977 | Fresard | 112/264 |

*Primary Examiner*—Peter Nerbun

*Attorney, Agent, or Firm*—David L. Davis; Robert E. Smith; Edward L. Bell

[57] ABSTRACT

A method of forming a buttonhole pattern including two spaced-apart rows of zig zag stitches so that each row is formed in a like manner includes sewing a row of narrow zig zag cording stitches in a first direction and subsequently covering the cording stitches with one of the parallel rows of zig zag stitches formed in a second direction and repeating these steps for the second of the parallel rows.

3 Claims, 4 Drawing Figures

| ENCODED DATA FOR LARGE BUTTONHOLE | | | |
|---|---|---|---|
| STITCH NO. | CODE | FEED INCREMENT(IN.) | BIGHT POSITION(IN.) |
| 1 | 10010011110 | 0.0 | 0.0 |
| 2 | 10010000110 | 0.0 | 0.120 |
| 3 | 00111110110 | 0.017 | -0.120 |
| 4 | 10010000110 | 0.0 | 0.120 |
| 5 | 11101110110 | -0.017 | -0.120 |
| 6 | 10010000110 | 0.0 | 0.120 |
| 7 | 00111110110 | 0.017 | -0.120 |
| 8 | 10010000110 | 0.0 | 0.120 |
| 9 | 00111001100 | 0.017 | 0.090 |
| 10 | 00111010101 | 0.017 | 0.050 |
| 11 | 10010000110 | 0.0 | 0.120 |
| 12 | 11101110110 | -0.017 | -0.120 |
| 13 | 10010000110 | 0.0 | 0.120 |
| 14 | 00111110110 | 0.017 | -0.120 |
| 15 | 10010000110 | 0.0 | 0.120 |
| 16 | 11101110110 | -0.017 | -0.120 |
| 17 | 00111000110 | 0.017 | 0.120 |
| 18 | 11101011010 | -0.017 | 0.020 |
| 19 | 11101000110 | -0.017 | 0.120 |
| 20 | 11101011011 | -0.017 | 0.020 |
| 21 | 11101000110 | -0.017 | 0.120 |
| 22 | 00111110000 | 0.017 | -0.090 |
| 23 | 00111101001 | 0.017 | -0.050 |
| 24 | 11101110110 | -0.017 | -0.120 |
| 25 | 11101100011 | -0.017 | -0.020 |
| 26 | 11101110110 | -0.017 | -0.120 |
| 27 | 10010101110 | 0.0 | -0.080 |
| 28 | 10010110110 | 0.0 | -0.120 |
| 29 | 00000111110 | END OF PATTERN | |

Fig. 3

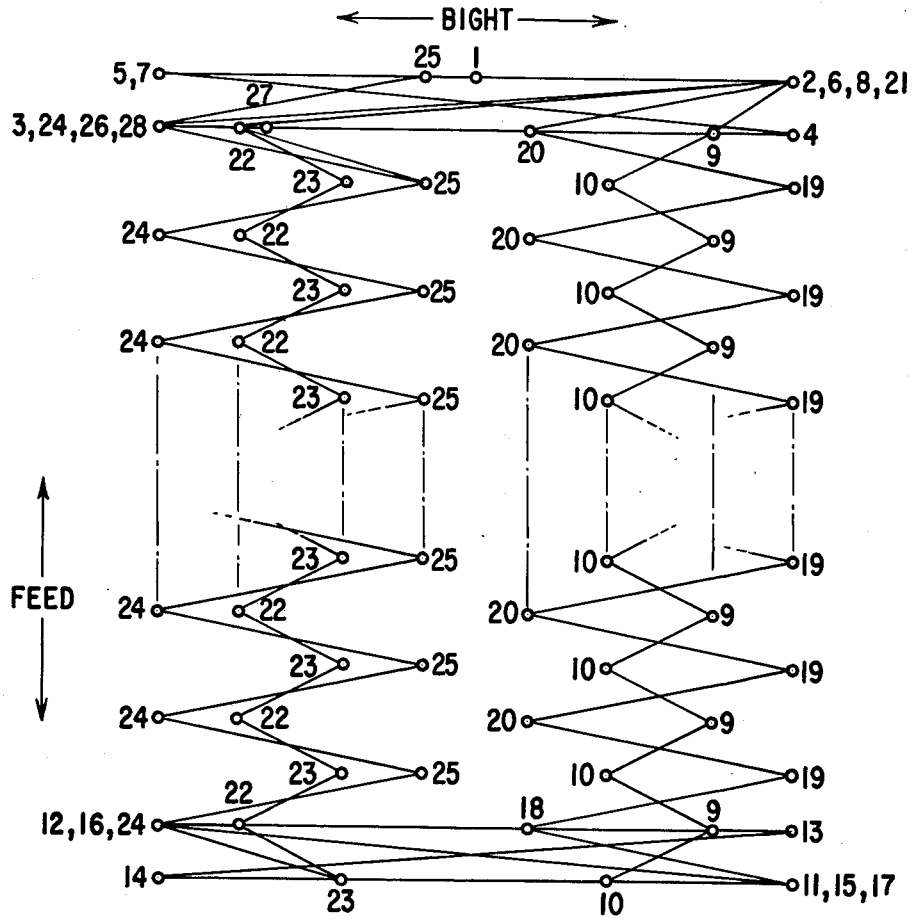
BIGHT
FEED
5,7
3,24,26,28
24
24
24
24
12,16,24
14
25
1
27
22
23
25
22
23
25
22
23
25

METHOD OF FORMING A BUTTONHOLE PATTERN

DESCRIPTION

BACKGROUND OF THE INVENTION

This invention relates to a method of sewing a buttonhole pattern and, more particularly, to an improved method for sewing such a pattern wherein the side bars are formed by sewing in the same direction to provide a uniform and esthetically pleasing appearance.

A conventional buttonhole pattern sewn by a conventional zig zag stitch household sewing machine includes two spaced-apart parallel rows of zig zag stitches, called side bars, joined at their ends by barring stitches of greater width and extending across both rows of side bar stitches. The separation between the rows of side bar stitches defines the cutting space of the buttonhole.

It the two rows of zig zag stitches forming the side bars of the buttonhole pattern are produced by first sewing one row of zig zag side bar stitches in a first direction and subsequently sewing the other row of zig zag side bar stitches in the opposite direction, it is found that the stitches sewn in the second direction tend to differ in spacing and regularity as compared with the stitches sewn in the first direction, thus producing a buttonhole which is unsatisfactory from an appearance point of view.

One prior method used to avoid the above-mentioned disadvantage is to reverse the work or material by 180° upon completion of the first row of zig zag side bar stitches. This procedure is highly combursome and impractical in cases of relatively large work pieces or large sizes of sewing material.

Another prior method consists in lifting the presser foot upon completion of the first row of zig zag side bar stitches and pulling back the work to a position in line with and spaced laterally from the starting point, and then sewing a second row of zig zag stitches parallel to and in the same direction as the first row. This results in the final buttonhole having an obliquely extending cross-over thread from the end of the first row to the beginning of the second row due to the pulling back of the work, which is considered an impairment of the appearance of the buttonhole as well as causing other difficulties and defects.

Still another prior method is disclosed in U.S. Pat. No. 2,977,913, wherein a first row of zig zag stitches is sewn in one direction, a line of straight short stitches is sewn in the opposite direction in laterally spaced and parallel relationship to the first row, and then a second row of zig zag stitches is sewn in the same direction as the first row to overlie the line of straight short stitches. Depending upon the thread used, the row of zig zag stitches sewn over the line of straight short stitches may be visibly different from the simple row of zig zag stitches sewn without underlying straight stitches. The sewing machine operator must make many sewing machine adjustments to produce a simple buttonhole, changing from zig zag stitching to straight stitching and then back to zig zag stitching, which is time consuming and a burden on the operator. Also, because the controls of the sewing machine must be changed from a first zig zag stitch position to a second straight stitch position and then back to a third zig zag stitch position, the rows of zig zag stitches may not be uniform due to a slight difference in the setting of the zig zag stitch position between making the first row and second row of zig zag stitches.

Yet another prior method is disclosed in U.S. Pat. No. 3,570,433, wherein parallel rows of zig zag stitches are sewn in the same direction of feed, each row overlying a line of long stitches formed in the opposite direction of feed. This patent discloses a further method wherein parallel rows of zig zag stitches are sewn in the same direction of feed, one of the rows overlying a row of long zig zag stitches of the same width as the top row. The second of these methods results in a non-uniform appearance of the two side bars. The first of these methods does provide a uniform appearance of the side bars but each of the side bars is formed with a narrow ridge running down the center thereof.

It is therefore an object of the present invention to provide an improved method of forming a buttonhole pattern including a pair of parallel rows of zig zag stitches, whereby the above-mentioned and related difficulties and drawbacks are substantially avoided.

It is another object of this invention to provide an improved method of forming a buttonhole pattern including parallel rows of zig zag stitches where the individual rows are characterized both by an exact parallelism as well as by an equal structure and uniform appearance of the stitches.

It is yet another object of this invention to provide an improved method of forming a buttonhole pattern including parallel rows of zig zag stitches which is of increased strength.

It is still another object of this invention to provide an improved method of forming a buttonhole pattern including parallel rows of zig zag stitches wherein the side bars are crowned to provide an attractive appearance.

SUMMARY OF THE INVENTION

The foregoing and additional objects are attained in accordance with the principles of this invention by providing a method of operating a zig zag sewing machine to produce a buttonhole pattern including two spaced-apart rows of zig zag stitches, each row having a width less than one half the total width of the two parallel rows side by side, there being a separation between the two parallel rows to define the cutting space of the buttonhole pattern, the method comprising the steps of sewing a first row of narrow zig zag cording stitches in a first direction extending the length of the buttonhole pattern, the cording stitches having a width less than the width of one of the parallel rows, sewing one of the parallel rows of zig zag stitches in a second direction opposite the first direction extending the length of the buttonhole pattern and overlying the first row of cording stitches, sewing a second row of narrow zig zag cording stitches in the first direction extending the length of the buttonhole pattern, the cording stitches having a width less than the width of one of the parallel rows, the second row of cording stitches being parallel to the first row of cording stitches and spaced therefrom by a distance greater than the cutting space and sewing the second of the parallel rows of zig zag stitches in the second direction extending the length of the buttonhole pattern and overlying the second row of cording stitches.

BRIEF DESCRIPTION OF THE DRAWING

The foregoing will be more readily apparent upon reading the following description in conjunction with the drawing in which:

FIG. 3 is a table of encoded data for producing a buttonhole pattern in accordance with the method of this invention; and FIG. 4 is a representation of the buttonhole pattern formed from the data illustrated in FIG. 3.

DESCRIPTION OF THE PREFERRED EMBODIMENT

Figure 1:
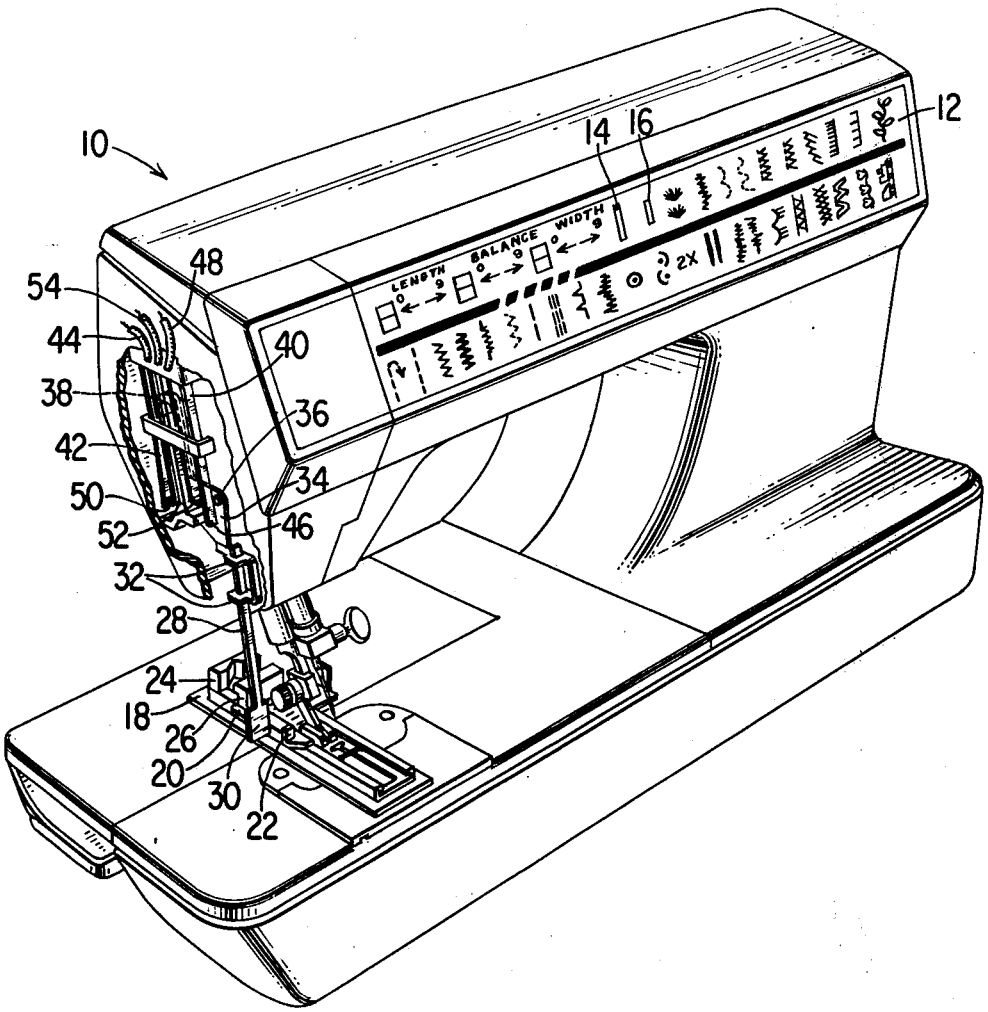
FIG. 1 is a perspective view of a sewing machine in which the method according to this invention may be practiced.

Referring to the drawings, FIG. 1 illustrates a sewing machine indicated generally at 10 having a control panel 12 illustratively of the type utilizing a continuous planar element such as a glass panel to which circuitry is applied as by deposition or the like to provide controls sensitive to the touch of an operator's finger. Indicated on the control panel 12 are touch sensitive areas having respective representations of various stitch patterns which may be automatically sewn by the sewing machine 10. For an understanding of the manner in which automatic pattern sewing may be accomplished, the reader is referred to U.S. Pat. No. 3,872,808, issued to John W. Wurst on Mar. 25, 1975, the disclosure of which is hereby incorporated by reference.

The subject invention is concerned with the sewing of a buttonhole pattern. The sewing machine 10 is provided with the capability of sewing either a large buttonhole, indicated by the large buttonhole representation 14 on the control panel 12, or a small buttonhole, indicated by the small buttonhole representation 16 on the control panel 12. When a buttonhole pattern is to be sewn, a buttonhole presser foot 18 is installed on the sewing machine 10. The buttonhole presser foot 18 is of the type described in U.S. Pat. No. 3,877,403, which issued to Stanley J. Ketterer on Apr. 15, 1975. The buttonhole presser foot 18 includes a fixed rear stop menber 20 and an adjustable front stop member 22, the distance therebetween defining the length of the buttonhole pattern being sewn, as determined by the size of button inserted between an anchor element 24 and a buttonhole gauging element 26. The sewing machine 10 further includes a switch mechanism including a lever arm 28 terminating in a paddle 30 at its lower end. The other end of the lever arm 28 is received by openings in a pair of space lugs 32 formed at one end of a lever 34. The lever arm 28 may be therefore be selectively raised and lowered by an operator, the operator lowering the lever arm 28 so that the paddle 30 is intermediate the stops 20 and 22 during the formation of a buttonhole pattern.

The lever 34 is pivoted at 36 and at the end opposite the lugs 32 has a pin 38 mounted thereon for cooperation with an electrical switch member 40. The switch member 40 includes a first fixed contact 42 connected to a wire 44, a second fixed contact 46 connected to a wire 48, a first movable contact 50 and a second movable contact 52, the first and second movable contacts 50 and 52 being connected to a wire 54. The pin 38 mounted on the lever 34 is intermediate the movable contacts 50 and 52. When the buttonhole presser foot 18 is positioned for needle penetrations at a first end of a buttonhole pattern, the paddle 30 is in contact with the stop 20 and is pushed forward so that the lever 34 pivots about the pivot point 36 and causes the pin 48 to push the movable contact 50 against the fixed contact 42. At the other end of the buttonhole pattern, the buttonhole presser foot 18 is moved rearward so that the stop 22 moves the paddle 30 back which causes the lever 34 to pivot about the pivot point 36, causing the pin 38 to push the movable contact 52 against the fixed contact 46. The significance of this action will become apparent from the description which follows.

Figure 2:
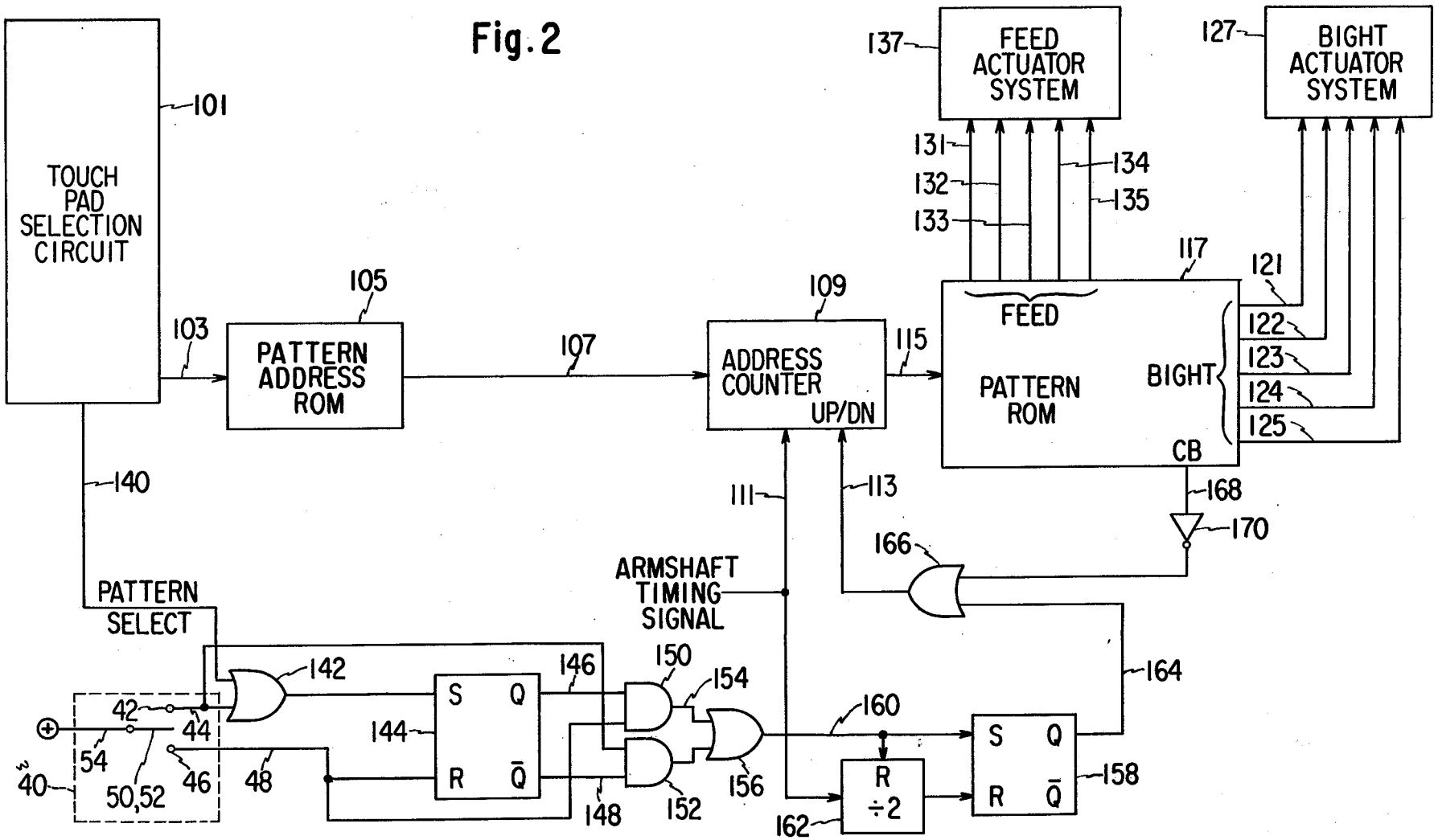
FIG. 2 forms a block schematic diagram of illustrative circuitry which may be utilized to control the sewing machine of FIG. 1 to practice the method of this invention.

Referring now to FIG. 2, the circuitry shown therein is a portion of the total circuitry which is responsive to an operator's finger touching selected areas of the control panel 12 for controlling the operation of the sewing machine 10 to form stitches in a selected pattern in accordance with information stored in a memory. For an explaination of the manner in which control signals may be generated in response to an operator's finger touching a selected area, the reader is referred to U.S. Patent Application Ser. No. 882,006, filed Feb. 28, 1978, and assigned to the same assignee of the present invention, the disclosure of which application is hereby incorporated by reference. Circuitry for generating such touch initiated control signals is represented in FIG. 2 by the block 101 labeled "Touch Pad Selection Circuit". The touch of a selected pattern area, such as the pattern area 14 (FIG. 1) for the large buttonhole pattern, causes an appropriate pattern selector code word to be provided by the touch pad selection circuit 101 on the leads 103 to the pattern address ROM 105. The pattern address ROM 105 provides over the leads 107 to the address counter 109 a code word representing the selected pattern. This code word on the leads 107 determine the starting point of the address counter 109 which has a count input line 111 upon which are provided pulses from the arm shaft pulse generator (not shown). Additionally, the address counter 109 has an input lead 113 for selectively controlling the address counter to count either up or down (i.e., increment or decrement) depending upon whether the signal applied to the lead 113 is high or low, respectively. The address counter 109 has output leads 115 which are connected to the inputs of a pattern ROM 115. The pattern ROM 115 has output lines 121, 122, 123, 124 and 125 upon which are provided a digital code word for the bight actuator system 127. Additionally, the pattern ROM 117 has output lines 131, 132, 133, 134 and 135 upon which are provided a digital code word for the feed actuator system 137. The bight actuator system 127 and the feed actuating system 137 are similar in construction and are adapted to convert a digital code word from the pattern ROM 117 into a mechanical position which locates the sewing machine needle in a conventional stitch forming instrumentality and provides a specific work feed for each needle penetration, as described in the above referenced U.S. Pat. No. 3,872,808.

Since the present invention is concerned with the formation of a buttonhole pattern, a description of the formation of a buttonhole pattern is in order at this time. Referring to FIG. 3, shown therein is encoded data for the formation of a large buttonhole pattern, such data being stored in the pattern ROM 117. FIG. 4 is a representation of the large buttonhole pattern formed from the data illustrated in FIG. 3. The code stored in the pattern ROM 117 comprises an eleven bit digital word for each stitch, as shown in the second column of FIG. 3. In each of these digital words, the five leftmost bits correspond to the feed increment, the next five bits correspond to the bight position, and the eleventh bit is a control bit, the purpose of which will be described in full detail hereinafter.

Referring to FIG. 4, each lateral bight actuator position and corresponding incremental feed displacement in the large buttonhole pattern coded as shown in FIG. 3 is represented by a small open circle, with the stitch number closely adjacent thereto. (The pattern of needle penetrations is actually the mirror image, about a vertical axis, of the pattern shown in FIG. 4) It is seen that the buttonhole pattern is formed in the following manner. The first eight stitches form the upper bar. Stitches nine and ten form the right side narrow cording stitches for the right side bar. Stitches 11–18 form the lever bar. Stitches 19 and 20 form the visible overlay stitches for the right side bar. Stitch number 21 finishes the right side bar. Stitches 22 and 23 form the narrow cording stitches for the left side bar. Stitches 24 and 25 form the visible overlay stitches for the left side bar. Finally, stitches 26–28 form the tying stitches for the buttonhole pattern. It is noted that the visible overlay stitches for both the left and right side bars are sewn in the same direction. Thus, control of the feed balance is not necessary to provide for the formation of a uniform and consistent buttonhole pattern. It is further noted that the 11th bit of the code word, designated the "control bit", is a ONE in only 4 stitches. As will be described hereinafter, when the control bit is a ONE this causes the address counter 109 to count down rather than up and therefore to address the previous word again. In this way, a side bar of infinite length may be sewn from only two ROM words which form a "loop", the exit from which is controlled by operation of the switch member 40 (FIG. 1) at both ends of the buttonhole pattern.

The formation of the aforedescribed loop and the function of the switch member 40 will now be described with reference to FIG. 2. When a new pattern is selected, a signal is applied to the lead 140 from the touch pad selection circuit 101. This signal is transmitted to the OR gate 142 to set the flip flop 144. When the flip flop 144 is set, there is a high signal on the Q output on the lead 146 and a low signal on the $\overline{Q}$ output on the lead 148. This condition enables the AND gate 150 and disables the AND gate 152. Thus, multiple closures of the switch member 40 on the first side (contacts 42 and 50) are ignored. The buttonhole foot 18 and the switch member 40 are so mounted that at the end of stitching of the first side bar, the second contact (contacts 46 and 52) will close. The AND gate 150 will then transmit a short pulse over the lead 154 until disenabled by the resetting of the flip flop 144, which simultaneously enables the AND gate 152. Now multiple contacts on the second side of the switch member 40 will be ignored. This circuitry thus achieves three functions:

1. It debounces the mechanical switch member 40;
2. Only closures on alternate sides of the switch member 40 are recognized; and
3. It generates a short setting pulse through the OR gate 156 for the flip flop 158.

In this way a single pulse is developed on the line 160 each time the buttonhole foot 18 reaches the end of its travel. The flip flop 158 and the divide by two circuit 162 are interconnected such that the output of the flip flop 158 on the lead 164 remains high for two stitches following a recognized closure of the switch member 40. During these two stitches the high signal on the lead 164 is transmitted through the OR gate 166 to insure a high signal on the lead 113 which controls the address counter 109 to increment. This stitch interval insures that the looping instruction, previously described, is ignored by the address counter 109 until two stitches after a recognized switch closure. The looping instruction is implemented by having the control bit outputted from the pattern ROM 117 over the lead 168. This control bit on the lead 168 is inverted by the inverter 170 and transmitted through the OR gate 166 to the up/down input lead 113 of the address counter 109. Thus, with the flip flop 158 reset, the control bit signal on the lead 168 controls the direction of counting of the counter 109, a ONE value of the control bit causing the counter 109 to decrement and a ZERO value of the control bit causing the counter 109 in increment. As previously mentioned, for the buttonhole pattern coding shown in FIG. 3, only four stitches have a control bit value of ONE so that only these four stitches cause looping. Closure of the switch member 40 at the end of a buttonhole pattern causes the flip flop 158 to be set, eliminating control of the counter 109 from the value of the control bit, thereby causing the loop to be exited.

Referring now to FIG. 4, shown therein is a representation of a buttonhole pattern sewn in accordance with the encoded data of FIG. 3. In FIG. 4, lateral bight actuator positions and corresponding incremental feed displacements are indicated by open circles having closely adjacent thereto the corresponding stitch number(s) from the leftmost column of FIG. 3. In the buttonhole pattern shown in FIG. 4, the overall width of the buttonhole pattern is the distance between the leftmost stitches and the rightmost stitches, such as between stitches 24 and 19, and the buttonhole cutting space is defined as the region intermediate the innermost stitches, that is between stitches 20 and 25. It is noted from an examination of the encoded data shown in FIG. 3 that the only stitches in the buttonhole pattern wherein the control bit is a ONE are the stitch numbers 10, 20, 23 and 25. Stitches 20 and 25 are the innermost stitches of the overlay stitches and define the cutting space and stitches 10 and 13 are the innermost stitches of the cording stitches.

It is seen from an examination of FIG. 4 that the buttonhole pattern produced in accordance with the principles of this invention includes two spaced apart rows of zig zag stitches, each row having a width less than one half the total width of the two parallel rows side by side, there being a separation between the two parallel rows to define the cutting space of the buttonhole pattern. The buttonhole is sewn by sewing a first row of narrow zig zag cording stitches in a first direction extending the length of the buttonhole pattern, the cording stitches having a width less than the width of one of the parallel rows. Next, there is sewn one of the parallel rows of zig zag stitches in a second direction opposite the first direction extending the length of the buttonhole pattern and overlying the first row of cording stitches. Next, there is sewn a second row of narrow zig zag cording stitches in the first direction extending the length of the buttonhole pattern, the cording stitches having a width less than the width of one of the parallel rows, the second row of cording stitches being parallel to the first row of cording stitches and spaced therefrom by a distance greater than the cutting space. Finally, there is sewn the second of the parallel rows of zig zag stitches in the second direction extending the length of the buttonhole pattern and overlying the second row of cording stitches. Further, at each end of the buttonhole pattern, there is sewn a respective plurality of zig zag barring stitches having a width equal to the total width of the buttonhole pattern. It will be noted that there are equal programmed feed increments, forward and reverse, for all stitches having a feed increment.

The buttonhole pattern just described provides a buttonhole of increased strength and improved appearance, over the corresponding characteristics of prior art buttonholes. The increased strength is attained by utilizing approximately 50 percent more thread in each side bar as was utilized in prior buttonhole formation. The improved appearance is attained because the narrow zig zag cording stitches underlying the visible zig zag side bar stitches give a crowned effect to the side bars, allowing the buttonhole stitches to "stand out" from the material upon which they are sewn.

Accordingly, there has been disclosed an improved method of sewing a buttonhole pattern. It is understood that the above-described method is merely illustrative of the application of the principles of this invention, and it is only intended that this invention be limited by the scope of the appended claims.

We claim:

1. A method of operating a zig zag sewing machine to produce a buttonhole pattern including two spaced-apart rows of zig zag stitches, each row having a width less than one half the total width of the two parallel rows side by side, there being a separation between the two parallel rows to define the cutting space of the buttonhole pattern, said method comprising the steps of:

(a) sewing a first row of narrow zig zag cording stitches in a first direction extending the length of the buttonhole pattern, said cording stitches having a width less than the width of one of said parallel rows;

(b) sewing one of said parallel rows of zig zag stitches in a second direction opposite said first direction extending the length of said buttonhole pattern and overlying said first row of cording stitches;

(c) sewing a second row of narrow zig zag cording stitches in said first direction extending the length of the buttonhole pattern, said cording stitches having a width less than the width of one of said parallel rows, said second row of cording stitches being parallel to said first row of cording stitches and spaced therefrom by a distance greater than said cutting space; and (d) sewing the second of said parallel rows of zig zag stitches in said second direction extending the length of said buttonhole pattern and overlying said second row of cording stitches.

2. The method of claim 1 further including the steps of:

(e) prior to step a), sewing a first plurality of zig zag barring stitches having a width equal to the total width of the buttonhole pattern; and (f) between steps (a) and (b), sewing a second plurality of zig zag barring stitches having a width equal to the total width of the buttonhole pattern.

3. The method of claim 1 wherein the feed increments for all stitches having a feed increment are essentially equal.

* * * * *